US010641551B2

(12) United States Patent
Van Asbrouck

(10) Patent No.: US 10,641,551 B2
(45) Date of Patent: May 5, 2020

(54) DRYING SYSTEM, A METHOD AND A COMPUTER PROGRAM PRODUCT

(71) Applicant: Rhino Research Europe B.V., Aalten (NL)

(72) Inventor: Johan Gaston Marie Van Asbrouck, Phichit (TH)

(73) Assignee: Rhino Research Europe B.V., Aalten (NL)

( * ) Notice: Subject to any disclaimer, the term of this patent is extended or adjusted under 35 U.S.C. 154(b) by 16 days.

(21) Appl. No.: 15/566,180

(22) PCT Filed: Apr. 19, 2016

(86) PCT No.: PCT/NL2016/050275

§ 371 (c)(1),
(2) Date: Oct. 12, 2017

(87) PCT Pub. No.: WO2016/171550

PCT Pub. Date: Oct. 27, 2016

(65) Prior Publication Data

US 2018/0087837 A1 Mar. 29, 2018

(30) Foreign Application Priority Data

Apr. 20, 2015 (EP) ..... 15164276

(51) Int. Cl.
*F26B 5/16* (2006.01)
*F26B 21/08* (2006.01)

(52) U.S. Cl.
CPC ..... *F26B 5/16* (2013.01); *F26B 21/083* (2013.01)

(58) Field of Classification Search
CPC ..... F26B 5/16; F26B 21/083
USPC ..... 34/474
See application file for complete search history.

(56) References Cited

U.S. PATENT DOCUMENTS 5,335,719 A * 8/1994 Khelifa ..... B60H 1/00007 165/42
5,435,150 A * 7/1995 Khelifa ..... B60H 1/00007 165/42
6,000,144 A * 12/1999 Bussmann ..... A23F 5/043 34/332
6,638,429 B1 * 10/2003 Bussmann ..... C02F 11/008 210/669

(Continued)

FOREIGN PATENT DOCUMENTS

DE 196 41 404 4/1998
DE 10 2004 013 447 9/2005
EP 3086068 A1 * 10/2016 ..... F26B 5/16

OTHER PUBLICATIONS

International Search Report and Written Opinion for PCT/NL2016/050275, dated Sep. 22, 2016, 15 pages.

*Primary Examiner* — Stephen M Gravini
(74) *Attorney, Agent, or Firm* — Morrison & Foerster LLP

(57) ABSTRACT

The invention relates to a drying module for drying humid air. The module comprises a humid air inflow opening, a dry air outflow opening and a flow channel extending between the inflow opening and the outflow opening. The flow channel includes a drying chamber for accommodating a zeolite container containing zeolite particles, wherein the drying chamber has at least one dimension transverse to a humid air flow direction that is significantly larger than a dimension of the drying chamber parallel to the flow direction of the humid air.

13 Claims, 3 Drawing Sheets

(56) References Cited

U.S. PATENT DOCUMENTS

| | | | | |
|---|---|---|---|---|
| 6,910,283 | B1 * | 6/2005 | Reddy | D21F 5/182 162/207 |
| 6,935,050 | B2 * | 8/2005 | Bookbinder | C01B 7/07 34/416 |
| 7,207,123 | B2 * | 4/2007 | Tanahashi | B01D 53/06 34/80 |
| 7,954,254 | B2 * | 6/2011 | Bussmann | B01D 39/1623 203/1 |
| 8,601,716 | B2 * | 12/2013 | Jerg | A47L 15/481 34/329 |
| 9,389,016 | B2 * | 7/2016 | Van Asbrouck | A01C 1/00 |
| 9,506,695 | B2 * | 11/2016 | Kim | F26B 21/003 |
| 2018/0087837 | A1 * | 3/2018 | Van Asbrouck | F26B 21/083 |

* cited by examiner

DRYING SYSTEM, A METHOD AND A COMPUTER PROGRAM PRODUCT

CROSS-REFERENCE TO RELATED APPLICATIONS

This application is the national phase of PCT application PCT/NL2016/050275 having an international filing date of 19 Apr. 2016, which claims benefit of European patent application No. 15164276.6 filed 20 Apr. 2015. The contents of the above patent applications are incorporated by reference herein in their entirety.

FIELD OF THE INVENTION

The invention relates to a drying system for drying humid air.

BACKGROUND OF THE INVENTION

Drying seeds is a crucial part in most seed processes. The quality and the longevity, very important factors for profitability for each seed business, are enormously influenced by drying.

Especially in areas with high ambient temperatures and/or high air moisture contents, such as in Asia, the non-trivial issue of drying and storing seeds is even a higher challenge.

Investment costs for adequate drying and storage systems are high. Further, the exploitation of such drying and storage systems suffer from irregular and unpredictable performance. Energy costs are soaring and are adding another challenging dimension to drying and storing seeds. In addition, adequate resources and infrastructure are often not available in those environments where seed drying and storage facilities are definitely needed.

Generally, the application of beads for drying seeds is a promising technology due to their drying performance and its nearly unending intrinsic regeneration possibilities. However, it appears in practice that regeneration of beads is rather cumbersome and labor intensive. Then, the drying system is not in operation during an uncertain period of time.

SUMMARY OF THE INVENTION

It is an object of the present invention to provide an improved drying system. Thereto, the drying system includes a drying module for drying humid air, comprising a humid air inflow opening, a dry air outflow opening and a flow channel extending between the inflow opening and the outflow opening, the flow channel including a drying chamber for accommodating a zeolite container containing zeolite particles, wherein the drying chamber has at least one dimension transverse to a humid air flow direction that is significantly larger than a dimension of the drying chamber parallel to the flow direction of the humid air.

By orienting the drying chamber such that at least one dimension of the chamber transverse to the humid air flow direction is significantly larger than a dimension of the drying chamber parallel to the flow direction of the humid air, a relatively low flow resistance is applied for the air flow flowing through the drying chamber. As a result, relatively small air flow inducing elements such as fans can be used. Generally, a simple, energetically efficient and effective drying system is obtained, especially if the humid air flow direction is substantially horizontal.

The invention also relates to a drying method.

Further, the invention relates to a computer program product. A computer program product may comprise a set of computer executable instructions stored on a data carrier, such as a flash memory, a CD or a DVD. The set of computer executable instructions, which allow a programmable computer to carry out the method as defined above, may also be available for downloading from a remote server, for example via the Internet.

Further advantageous embodiments according to the invention are described in the following claims.

DESCRIPTION OF THE DRAWINGS

By way of example only, embodiments of the present invention will now be described with reference to the accompanying figures, in which.

It is noted that the figures show merely preferred embodiments according to the invention. In the figures, the same reference numbers refer to equal or corresponding parts.

DETAILED DESCRIPTION OF THE INVENTION

Figure 1:
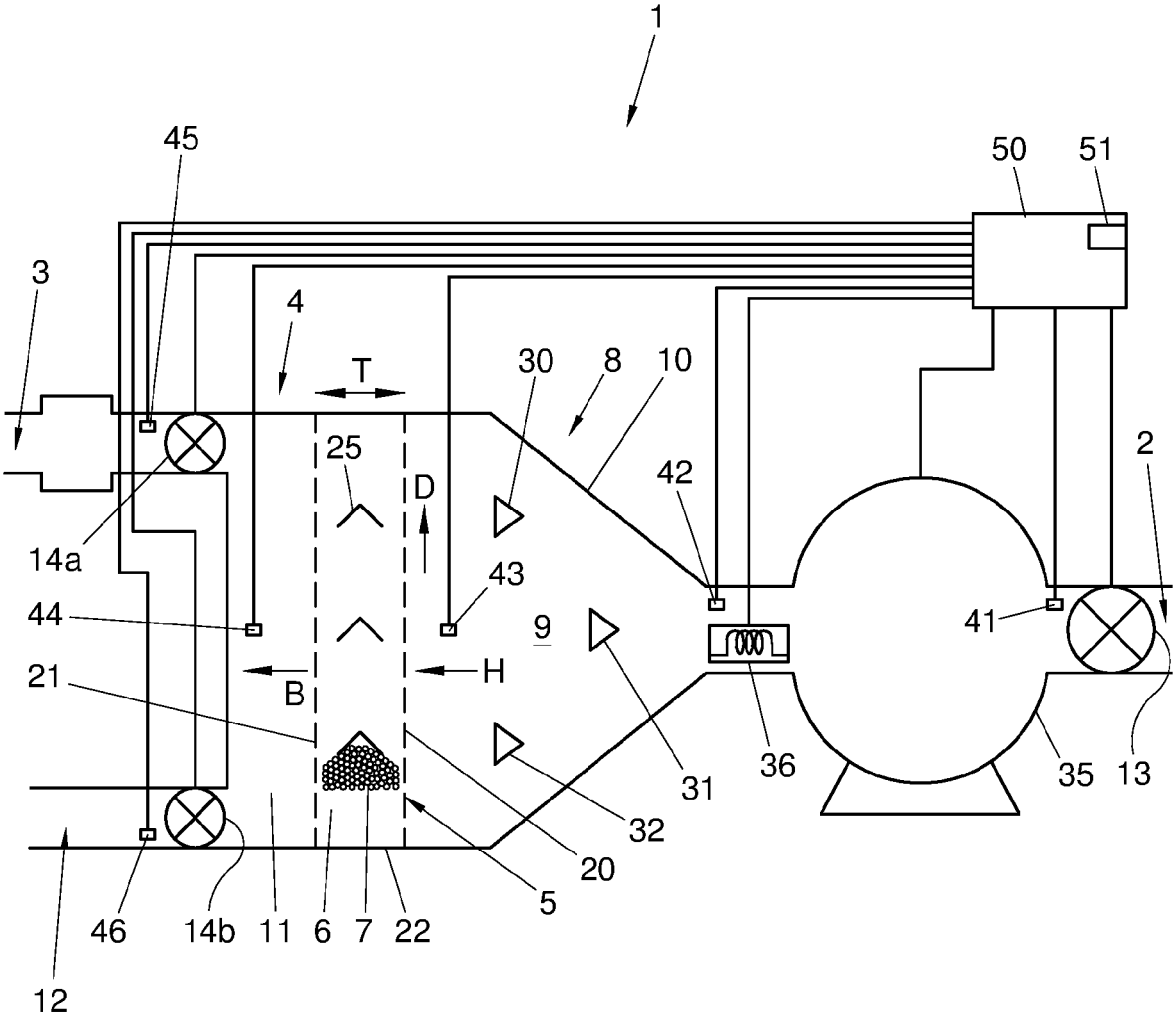
FIG. 1 shows a schematic cross sectional view of a drying system including a drying module according to the invention.

FIG. 1 shows a schematic cross sectional view of a drying system including a drying module 1 according to the invention. The drying module 1 is arranged for drying humid air, e.g. for the purpose of drying air that is flown through agricultural products such as seeds.

The drying module 1 comprising a humid air inflow opening 2, a dry air outflow opening 3 and a flow channel 4, 8 extending between the inflow opening 2 and the outflow opening 3. The flow channel 4 has a drying chamber 5 for accommodating a zeolite container 6 containing zeolite particles 7. Further, the drying chamber 5 has at least one dimension D oriented transverse to a humid air flow direction H that is significantly larger than a dimension of the drying chamber parallel to the flow direction H of the humid air.

In the shown embodiment, the drying chamber 5 is generally disc-shaped having a body axis B substantially parallel to the humid air flow direction H. Viewed along the body axis B, the exterior contour or periphery of the drying chamber is generally constant such as a rectangle, a square or a circle. In case of a square or circle, the length of the square or the diameter of the circle, respectively, is significantly larger than a thickness T of the drying chamber 5 along the humid air flow direction H. In case of a rectangle, the length and optionally also the width of the rectangle are significantly larger than the thickness T of the drying chamber 5. In principle, the cross sectional exterior contour of the drying chamber 5 may have another shape such as a polygon. By providing a chamber 5 having at least one transverse dimension that is significantly larger than the thickness of the disc, a relatively large amount of humid air can be flown through the chamber 5 per unit power that is required for delivering pressure to the humid air.

Advantageously, the thickness T of the drying chamber 5 in the humid air flow direction H is substantially constant so that a more or less uniform humid air flow density can be realized.

In a highly preferred embodiment, the zeolite container 6 is implemented as a removable cassette containing zeolite particles 7, also called beads, so that the zeolite particles 7 can easily be replaced. In another embodiment, the zeolite container 6 is at least partially permanently mounted in the drying chamber 5. The container 6 has generally the same geometry and dimensions as the drying chamber 5. In the shown embodiment, the cassette has an upstream surface 20, a downstream surface 21 and a side surface 22 that is rectangular.

The term "zeolite" refers to a family of micro-porous hydrated aluminosilicate minerals. More than 150 zeolite types have been synthesized and 48 naturally occurring zeolites are known. Zeolites have an "open" structure that can accommodate a wide variety of cations, such as Na+, K+, Ca2+, Mg2+ and others. These positive ions are rather loosely held and can readily be exchanged for others in a contact solution. Some of the more common mineral zeolites are: Amicite, Analcime, Barrerite, Bellbergite, Bikitaite, Boggsite, Brewsterite, Chabazite, Clinoptilolite, Cowlesite, Dachiardite, Edingtonite, Epistilbite, Erionite, Faujasite, Ferrierite, Garronite, Gismondine, Gmelinite, Gobbinsite, Gonnardite, Goosecreekite, Harmotome, Herschelite, Heulandite, Laumontite, Levyne, Maricopaite, Mazzite, Merlinoite, Mesolite, Montesommaite, Mordenite, Natrolite, Offretite, Paranatrolite, Paulingite, Pentasil, Perlialite, Phillipsite, Pollucite, Scolecite, Sodium Dachiardite, Stellerite, Stilbite, Tetranatrolite, Thomsonite, Tschernichite, Wairakite, Wellsite, Willhendersonite and Yugawaralite, all of which are equally suitable for use in the present invention. An example mineral formula is: $Na_2Al_2Si_3O_{10}$-$2H_2O$, the formula for natrolite. Naturally occurring zeolites are rarely pure and are contaminated to varying degrees by other minerals, metals, quartz or other zeolites. For this reason, naturally occurring zeolites are less preferred in many applications where uniformity and purity are essential, yet such impure zeolites are very suitable for the present application.

The term zeolite includes reference to zeolite granules, zeolite beads and zeolite particles. Example of commercially available zeolites are; Linde Type A (LTA), Linde Types X and Y (Al-rich and Si-rich FAU), Silicalite-1 and ZSM-5 (MFI), and Linde Type B (zeolite P) (GIS). Other commercially available synthetic zeolites include Beta (BEA), Linde Type F (EDI), Linde Type L (LTL), Linde Type W (MER), SSZ-32 (MTT), BRZ® (clinoptilolite). All are aluminosilicates. Further, Linde type A zeolite (NaA, KA, CaA), also referred to by the three-letter code LTA (Linde Type A) zeolites, or the 3A, 4A and/or 5A type can be used. The size of the zeolite particles as used herein is not particularly limited in aspects of the present invention.

In all cases zeolites can take up water from moisture or water vapour in a gas. Zeolites can hold up to circa 35% or more of their weight in water. By choosing the pore size of the zeolite such that the pores are e.g. about 4 ångström, the zeolite is merely capable of absorbing water ($H_2O$) having a size of circa 2.7 ångström, no other substances or at least hardly no other substances, thereby rendering the zeolite particles extremely apt and efficient for the purpose of absorbing water.

In the shown embodiment, the flow channel 4, 8 includes a pre-drying chamber 9 upstream to the drying chamber 5, the pre-drying channel section 9 having walls 10 that diverge in a direction towards the drying chamber 5. By providing diverging walls 10, the cross sectional area of the flow channel 4, 8 may increase from a first area, at an upstream location of the flow channel, to a second area, larger than the first area, at a location of the flow channel near the drying chamber 5. The walls 10 may diverge in a monotone manner, preferably in a linear way, forming an uniformly expanding channel section so that an upstream channel section having a relatively small cross sectional area is appropriately connected to the drying chamber.

During operation, the humid air flow direction H is substantially horizontal including embodiments wherein the drying module may be arranged to define a humid air flow direction that is somewhat tilted with respect to the horizontal direction. Then, any interaction between the flow, the mass of the zeolite particles and the gravity force may be minimized.

In the shown embodiment, the drying module 1 includes a control unit 50 provided with a processor for controlling operation of the module, viz. by operating controlling mechanisms in the module, e.g. valves etc, based on measured physical quantities at respective locations in the module.

The drying module further includes an exhaust air outflow opening 12 positioned downstream to the drying chamber 5. In the shown embodiment, the flow channel 4, 8 of the drying module 1 includes a post-drying channel section 11 downstream to the drying chamber 5 for selectively flowing the dried air to the dry air outflow opening 3 or to the exhaust air outflow opening 12. Thereto, valves 14*a,b* are provided controlling a flow through the dry air outflow opening 3 and the exhaust air outflow opening 12. The valves 14*a,b* are controlled via the control unit 50 of the drying module 1. Preferably, the exhaust air outflow opening 12 is located at a bottom side of the drying module so that any residual condensed moisture can be captured and removed via the exhaust air outflow opening 12. Further, in an advantageous embodiment, the exhaust air outflow opening 12 and the dry air outflow opening 3 are positioned remote from each other, preferably such that the mutual distance is relatively large, more preferably maximized, and/or such that the outflow directions of the openings 12, 3 are oriented away from each other, thereby reducing any heat transfer.

Further, the drying chamber 5 is provided with supporting elements 25 for supporting the zeolite particles 7. Preferably, the supporting elements 25 are positioned at equidistant heights so that they each support a substantially equal amount of zeolite particles, thereby contributing in providing substantially homogeneous flow resistance across the upstream and downstream surface 20, 21. The supporting elements 25 are preferably plate shaped, having a cap-shaped contour in their cross sectional view. In the shown example, the supporting elements have a folded contour that is oriented, when moving in the humid air flow direction H, first slightly upwardly and then, after reaching their upper position, slightly downwardly. By providing a supporting element having a cap-shaped contour it is counteracted that an air layer is formed below a supporting element 25, on top of a layer of zeolite particles, the air layer being accessible for a flow of air to be dried. It is noted that also other contours can be applied, e.g. a corrugated contour or a curved contour.

In the shown embodiment, the supporting elements 25 are situated somewhere between the upstream surface 20 and the downstream surface 21. In another embodiment, the supporting elements 25 are broader extending along the entire thickness T of the chamber 5, from the upstream surface 20 to the downstream surface 21.

Further, the pre-drying chamber 9 may include a deflector 30, 31, 32 for distributing inflowing humid air in a direction transverse to the humid air flow direction H. In the shown embodiment the pre-drying chamber 9 includes a multiple number of such deflectors, viz. three deflectors 30, 31, 32. The number of deflectors may depend on the relative increase in cross sectional area in the channel 4, 8 due to the diverging walls 10 and on the relative length of said diverging walls. Alternatively, the pre-drying chamber 9 merely includes a single deflector or no deflector at all.

The drying module 1 also includes a flow inducing element 35 such as a fan, arranged upstream to the diverging walls 10 for flowing humid air from the humid air inflow opening 2 towards the drying chamber 5. Between the humid air inflow opening 2 and the flow inducing element 35 an inflow valve 13 is provided for controlling the amount of humid air that is flowing into the drying module. Operation of the flow inducing element 35 and the inflow valve is controlled by the control unit 50.

Further, the drying module 1 includes a heater 36 arranged upstream to the pre-drying chamber 9 for heating inflowing humid air. The heater may be energized by electricity or fossil fuel or by any other energy source such as solar energy, wind energy etc.

It is noted that the drying module 1 can also be implemented without a flow inducing element and/or without a heater, e.g. when assembled in a larger air processing system.

In addition, the drying module 1 includes a multiple number of sensors. In the shown embodiment, a first sensor 41 is located upstream to the flow inducing element 35. The first sensor 41 is arranged for measuring a temperature and/or a humidity. A second sensor 42 is located downstream to the heater 36 for measuring a temperature. A third sensor 43 is located in the pre-drying module 9 for measuring a temperature and/or a humidity. A fourth sensor 44 is located in the post-drying channel section 11 for measuring a temperature and/or a humidity. A fifth sensor 45 is located upstream to the dry air outflow opening 3 for measuring a temperature, a humidity and/or a flow rate of dry air outflow. Further, a sixth sensor 46 is located upstream to the exhaust air outflow opening 12. In the shown embodiment, the data measured by the sensors are forwarded to the control unit 50 for controlling the drying module 1.

In other embodiments, more sensors can be used, e.g. at further locations in the drying module, or other physical parameters can be measured. Alternatively, less sensor can be applied. Further, a subset of sensor data can be processed in a local control subunit, e.g. for the purpose of pre-processing.

During operation, the drying module 1 can be active, e.g. in a drying mode, a regenerating mode or a cooling mode.

In the drying mode, valves are controlled such that the humid air inflow opening 2 and the dry air outflow opening 3 are open, while the exhaust air outflow opening 12 is closed. Then, a humid air flow is generated by the air inducing element 35 such that humid air flows from the humid air inflow opening 2 via the pre-drying chamber 9 and the drying chamber 5 towards the dry air outflow opening 3. The zeolite particles absorb moisture from the humid air so that the humid air is dried.

In the regenerating mode, valves are controlled such that the humid air inflow opening 2 and exhaust air outflow opening 12 are open, while the dry air outflow opening 3 is closed. Then, the heating element 36 is activated so that air induced by the air inducing element 35 flowing from the humid air inflow opening 2 towards the drying chamber 5 is preheated before being flown along the zeolite particles. The air is preferably heated to a temperature between circa 250 degrees Celsius and circa 300 degrees Celsius so that the zeolite particles release their moisture. When passing the drying chamber 5 the pre-heated air is moistened by moisture exuded by the zeolite particles. In this process the zeolite particles are regenerated. The processed air is flown to the exhaust air outflow opening 12, e.g. for discharge outside.

In the cooling mode, the zeolite particles are actively or passively cooled down.

The control unit 50 is arranged for controlling the modes of the drying module 1. As an example, the drying module 1 is operated in the drying mode until the zeolite particles are saturated. Then, the drying module can be operated in the regenerating mode until the zeolite particles have released their moisture.

Figure 2:
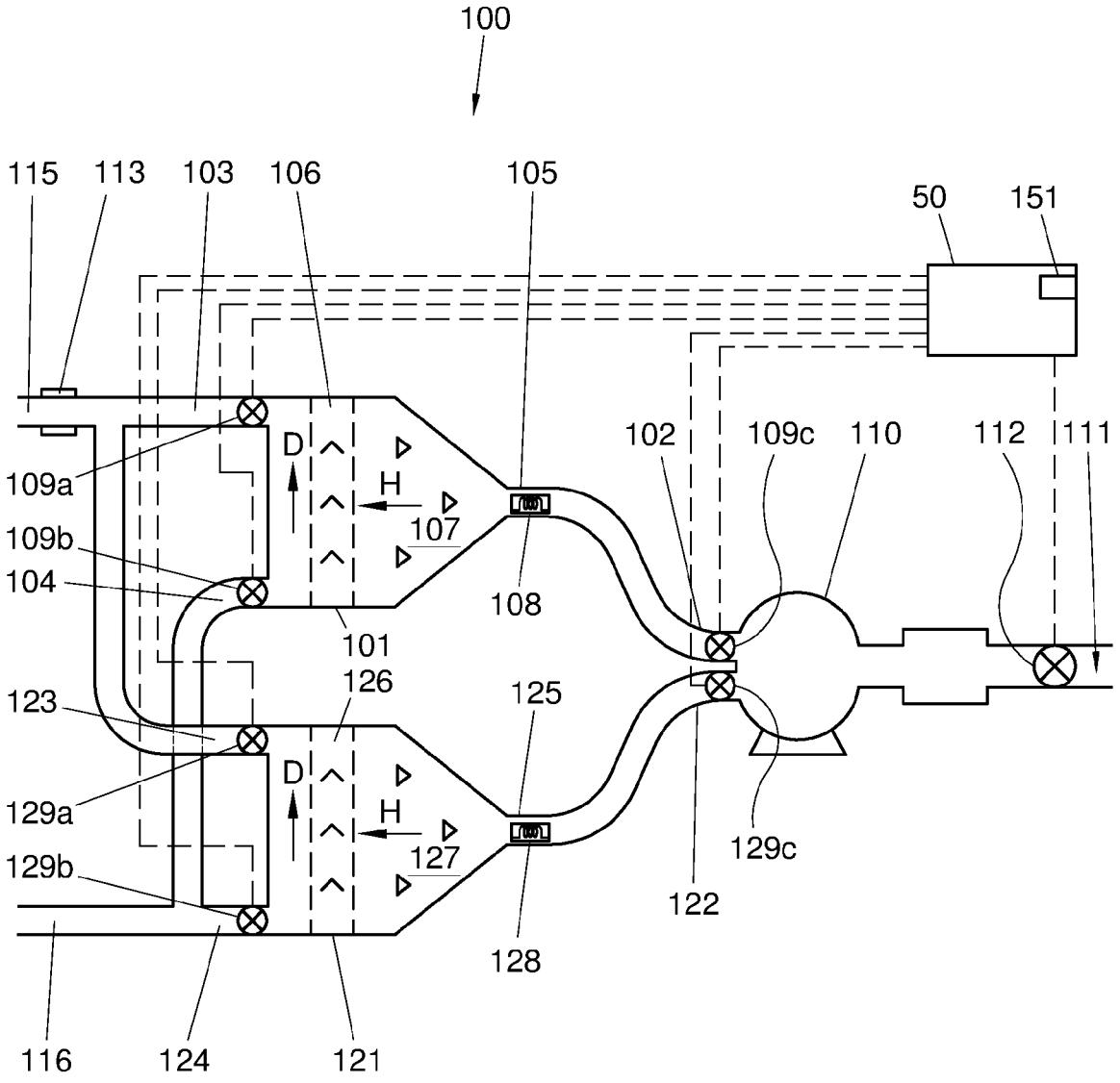
FIG. 2 shows a schematic cross sectional view of a drying system including two drying modules according to the invention.

FIG. 2 shows a schematic cross sectional view of a drying system 100 according to the invention. The drying system 100 includes two drying modules 101, 121, each of them including a humid air inflow opening 102, 122, a dry air outflow opening 103, 123, an exhaust air outflow opening 104, 124, a flow channel 105, 125, a drying chamber 106, 126, a pre-drying chamber 107, 127, a heater 108, 128 upstream to the respective drying chamber and a multiple number of valves 109*a-c*, 129*a-c* and sensors. The humid air inflow openings 102, 122 are connected to an outflow opening of the flow inducing element 110, via valves 109*c*, 129*c*. Further, the dry air outflow openings 103, 123 are connected to a single dry air system outflow opening 115, while the exhaust air outflow openings 104, 124 are connected to a single exhaust air system outflow opening 116. Upstream to the single dry air system outflow opening 115, a heat exchanger 113 is provided for cooling the outflow air, e.g. using ambient air. The drying system 100 also includes a control unit 50, an air intake opening 111 and a flow inducing element 110 arranged between the humid air inflow opening 101, 121 of the respective drying modules 101, 121 and the air intake opening 111. Again, between the air intake opening 111 and the flow inducing element 110 a valve 112 is arranged for controlling a flow of intake air. The control unit 50 is arranged for controlling the valves so that the individual drying modules 101, 121 are operated in a selected mode.

By using at least two separate drying modules 101, 121 a continuous flow of dried air can be provided since at least one of the drying modules can be operated in a drying mode. When the zeolite particles of a first drying module become saturated, the first drying module is switched into a regenerating mode. Simultaneously, a second drying module can then be switched into a drying mode.

Various modifications can be made. As an example, each of the drying modules 101, 121 can be provided with a flow inducing element. Further, each of the drying modules 101, 121 can be provided with an active cooling unit 113 arranged downstream to the drying chamber. Alternatively, the drying modules 101, 121 can be provided with an active cooling system located upstream to the drying chamber, e.g. using a heat exchanging device with a cooling liquid. By applying an active cooling system, the temperature of the flowing air can be cooled below ambient temperature. Further, the humidity of the flowing air can be conditioned at a lower level. However, the drying capacity of the zeolite particles is exploited more intensively.

In a further embodiment, the drying system includes another number of drying modules, e.g. three or four drying modules, or a single drying module, depending on a required drying capacity.

It is noticed, further, that for the process of regenerating the zeolite particles, also other media can be used, e.g. nitrogen.

The humid air is dried, e.g. for the purpose of drying seeds.

The term "seeds" refers to any live seed, e.g. live seeds that are used for the generation of progeny plants grown from the seeds when seeded, sowed or planted in or on a soil or suitable growth substratum. In fact, any seed can be used in the method of the invention. Particularly useful are seeds of wheat, oat, corn (mais), barley, rye, millet, rice, soy, rapeseed, linseed (flax), sunflower, carrot, black salsify, runner bean, goa bean, asparagus pea or winged bean, haricot bean, climbing bean or pole bean, snap bean, broad bean or field bean, garden pea or green pea, lupin, tomato, pepper, melon, pumpkin, cucumber, egg plant, zucchini, onion, leek, lettuce, endive, spinach, corn salad, gherkin, (red) cabbage, savoy cabbage, pointed cabbage, Chinese cabbage, pak-choi (bok choy), cauliflower, Brussels sprouts, sugar beet, beetroot, kohlrabi, chicory, artichoke, asparagus, broccoli, celeriac, celery, radish, grass and spices.

However, humid air can also be applied for other purposes, e.g. in climate control systems for conditioning air in buildings. In this respect it is noted that a humidity level can be conditioned below circa 35% Rh so that metabolic activities are kept at a minimum level, thereby reducing or even eliminating any influence of bacteria, fungi and/or insects.

Figure 3:
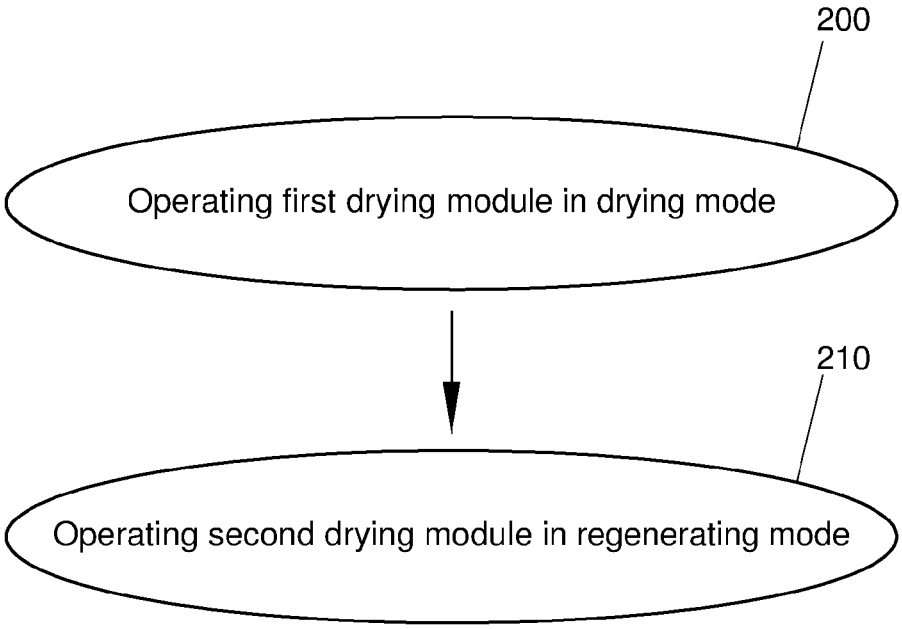
FIG. 3 shows a flow chart of steps of a method for drying humid air according to the invention.

FIG. 3 shows a flow chart of steps of a method for drying humid air using a drying system as described above. The method comprises a step of operating a first drying module in a drying mode 200, and a step of operating a second drying module in a regenerating mode 210.

The steps of operating a first drying module in a drying mode and a second drying module in a regenerating mode can be executed using dedicated hardware structures, such as FPGA and/or ASIC components. Otherwise, the method can also at least partially be performed using a computer program product comprising instructions for causing a processor of a computer system or a control unit to perform the above described steps of the method according to the invention. All steps can in principle be performed on a single processor. However it is noted that at least one step can be performed on a separate processor. As an example, the drying modules can each be controlled by a separate processor.

The invention is not restricted to the embodiments described above. It will be understood that many variants are possible.

These and other embodiments will be apparent for the person skilled in the art and are considered to fall within the scope of the invention as defined in the following claims. For the purpose of clarity and a concise description features are described herein as part of the same or separate embodiments. However, it will be appreciated that the scope of the invention may include embodiments having combinations of all or some of the features described.

The invention claimed is:

1. A drying system including a drying module for drying humid air, comprising a humid air inflow opening, a dry air outflow opening and a flow channel extending between the inflow opening and the outflow opening, the flow channel including a drying chamber for converting the humid air into dried air, said chamber accommodating a zeolite container which is a removable cassette containing zeolite beads, wherein the drying chamber has at least one dimension transverse to a humid air flow direction that is significantly larger than a dimension of the drying chamber parallel to the flow direction of the humid air.

2. The drying system of claim 1, wherein the flow channel includes a pre-drying chamber upstream to the drying chamber, the pre-drying chamber having walls that diverge in a direction towards the drying chamber.

3. The drying system of claim 1, wherein the drying chamber is generally disc-shaped having a body axis substantially parallel to the humid air flow direction.

4. The drying system of claim 1, wherein the humid air flow direction is substantially horizontal during operation.

5. The drying system of claim 1, wherein the flow channel further includes a post-drying channel section downstream to the drying chamber for selectively flowing the dried air to the dry air outflow opening or to an exhaust air outflow opening.

6. The drying system of claim 1, wherein the drying chamber includes supporting elements each element having a cross sectional cap-shaped contour for supporting zeolite beads.

7. The drying system of claim 1, wherein the pre-drying chamber includes a deflector for distributing inflowing humid air in a direction transverse to the humid air flow direction.

8. A drying system, including a single or a multiple number of drying modules, each module comprising a humid air inflow opening, a drying chamber and a dry air outflow opening, and a flow inducing element which is a fan arranged between the humid air inflow opening of the respective drying modules and an air intake opening wherein each module includes a pre-drying chamber measuring temperature and/or humidity and a heater upstream of said pre-drying chamber.

9. The drying system of claim 8, further including a cooling unit arranged for cooling a dried airflow flowing from the respective dry air outflow opening(s) of the drying modules using ambient air, or a forced cooling unit arranged for cooling humid air flowing to the respective humid air inflow opening(s) of the respective drying modules.

10. A method for drying humid air which comprises introducing humid air into the drying system of claim 8, wherein a first drying module is operated in a drying mode and a second drying module is operated in a regenerating mode.

11. The drying system of claim 8 which further comprises a computer program product for operating said drying system, the computer program product comprising computer readable code for causing a processor to perform the step of:

operating a first drying module in a drying mode, and operating a second drying module in a regenerating mode.

12. The drying system of claim 8, wherein the drying system consists of two modules.

13. The drying system of claim 6, wherein the supporting elements are at equidistant heights.

* * * * *